US006568673B2

(12) United States Patent
Mochizuki et al.

(10) Patent No.: US 6,568,673 B2
(45) Date of Patent: May 27, 2003

(54) APPARATUS FOR HANDLING PAPER SHEETS AND THE LIKE

(75) Inventors: Akira Mochizuki, Mito (JP); Tadashi Satou, Chiyoda (JP); Yasunari Niioka, Seto (JP); Riichi Katou, Nagoya (JP); Mizuki Kaii, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/912,371

(22) Filed: Jul. 26, 2001

(65) Prior Publication Data

US 2002/0096818 A1 Jul. 25, 2002

(30) Foreign Application Priority Data

Sep. 18, 2000 (JP) ..... 2000-286856
Jan. 19, 2001 (JP) ..... 2001-010985

(51) Int. Cl.[7] ..... B65H 39/00
(52) U.S. Cl. ..... 271/213; 271/311
(58) Field of Search ..... 902/12; 271/3.01, 271/311, 308, 303, 213, 216, 900, 902, 151, 18; 198/347.3; 242/528

(56) References Cited

U.S. PATENT DOCUMENTS 3,191,882 A * 6/1965 Riedel ..... 242/528
4,496,142 A * 1/1985 Iwasaki ..... 242/528
4,923,136 A * 5/1990 Honegger ..... 242/528
5,735,516 A * 4/1998 Gerlier et al. ..... 271/213
5,802,434 A * 9/1998 Takehara et al. ..... 271/308
5,971,393 A * 10/1999 Vernackt ..... 271/303
6,186,339 B1 * 2/2001 Saltsov et al. ..... 271/303

FOREIGN PATENT DOCUMENTS

JP 11-272913 11/1999

* cited by examiner

*Primary Examiner*—Donald P. Walsh
*Assistant Examiner*—Kenneth W Bower
(74) *Attorney, Agent, or Firm*—Antonelli, Terry, Stout & Kraus, LLP

(57) ABSTRACT

An apparatus for handling paper sheets and the like has a mechanism for discharging the paper sheets. The mechanism is provided with a scraper for scraping the paper sheets having wound around a wheel from the wheel. The scraper has a tip end and an opposite end that is rotatably supported in a direction close to or away from the wheel so that the tip end can maintain contact with an outer peripheral surface of the wound paper sheets. The scraper includes a first scraper section and a second scraper section. The first scraper section is rotatably supported in the direction close to or away from the wheel, and is urged toward an outer peripheral surface of the wheel. The second scraper section is rotatably supported on the first scraper section in the direction close to or away from the wheel, and is urged in a direction in which a tip end of the second scraper section rotates toward the outer peripheral surface of the wound paper sheets.

11 Claims, 5 Drawing Sheets

APPARATUS FOR HANDLING PAPER SHEETS AND THE LIKE

BACKGROUND OF THE INVENTION

The present invention relates to an apparatus for handling paper sheets and the like.

One of an apparatus for handling paper sheets and the like having a mechanism for discharging paper sheets and the like wound around a wheel is described, for example, in JP-A-11-272913 specification. This apparatus houses bills by winding a tape and the bills around the wheel, and discharges the bills by unwinding the tape. An arrangement is disclosed which is operative in discharging the bills from the wheel, to scrape the bills from the wheel, around which the bills have been wound together with the tape, using an elastic member constituting a tip portion of a scraper.

The above conventional example is configured so that the elastic member constituting the tip portion of the scraper is deformed to follow an outer peripheral surface of the wheel or the tape wound around the wheel in order to maintain contact therewith. If, however, any bill collides against the scraper and a paper jam thus occurs, an excessive force is applied to the elastic member. If the elastic member is deformed by the excessive force toward the downstream side of the rotating direction of the wheel effected during the discharge of the bills, the tip of the elastic member cannot collide against the bills so as to scrape them wound together with the tape around the wheel. Thus, the essential object of the scraper is not attained.

Further, the above conventional example makes no considerations for possible plastic deformation of the elastic member, which may result a gap in the contact between the elastic member and the wheel or the tape wound around the wheel.

Moreover, when rigidity of the elastic member is enhanced to prevent the elastic member from being deformed or broken under the excessive force, it cannot maintain contact with the outer peripheral surface of the tape wound around the wheel, that is, it cannot properly follow it. Thus, the essential object of the elastic member is not attained.

Further, the radius of the tape wound around the wheel increases in proportion to the number of bills stacked. As the radius increases, the elastic member is more and more significantly deformed, thus forming a gap between the tip of the elastic member and the outer peripheral surface of the tape. The function of scraping the bills wound together with the tape around the wheel is not achieved unless the tip of the scraper and the outer peripheral surface of the tape maintain contact with each other. In this case, the tip of the scraper can maintain contact with the outer peripheral surface if spring elasticity of the entire scraper is made smaller than the elasticity of the elastic member. In this case, however, an effect of the scraper that is obtained when the elastic member is elastically deformed is lost.

Further, with the scraper the tip portion of which is composed of the elastic member, if the outer peripheral surface of the tape wound around the wheel is irregular, the tip portion of the scraper and the outer peripheral surface of the tape wound around the wheel may not maintain sufficient contact with each other in the vicinity of the downstream side of the rotating direction of the wheel effected during the discharge of the bills.

That is, although this scraper is provided to scrape the bills from the wheel, if it is deformed or plastically deformed toward the downstream side of the rotating direction of the wheel observed during the discharge of the bills or if the outer peripheral surface of the tape wound around the wheel is irregular, the condition that the scraper tip maintains contact with the outer peripheral surface of the tape wound around the wheel is not established, that is, the essential function of the scraper is not achieved.

SUMMARY OF THE INVENTION

The present invention is provided in view of the above problems, and it is an object thereof to provide an apparatus for handling paper sheets and the like having high performance mechanism for discharging paper sheets and the like in which a scraper tip maintains contact with a wheel to thereby maintain its performance even if a paper jam or the like occurs.

To attain the above object, the present invention provides an apparatus for handling paper sheets and the like having a mechanism for discharging paper sheets and the like wound around a wheel, wherein the paper sheets discharging mechanism includes a scraper operative in discharging the paper sheets, to scrape the paper sheets wound around the wheel, and the scraper performs two or more levels of operations, and a tip of the scraper maintains contact with an outer peripheral surface of the wheel. The mechanism is further characterized in that the paper sheets discharging mechanism includes a scraper operative in discharging sheets, to scrape the sheets wound around the wheel, and the scraper includes a first scraper one end of which is rotatably fixed and a second scraper rotatably connected to the other end of the first scraper and having a tip portion in contact with an outer peripheral surface of the wheel.

DESCRIPTION OF THE PREFERRED EMBODIMENTS

One embodiment in which the present invention is applied to a bill handling device will be described below with reference to the drawings.

Figure 1:
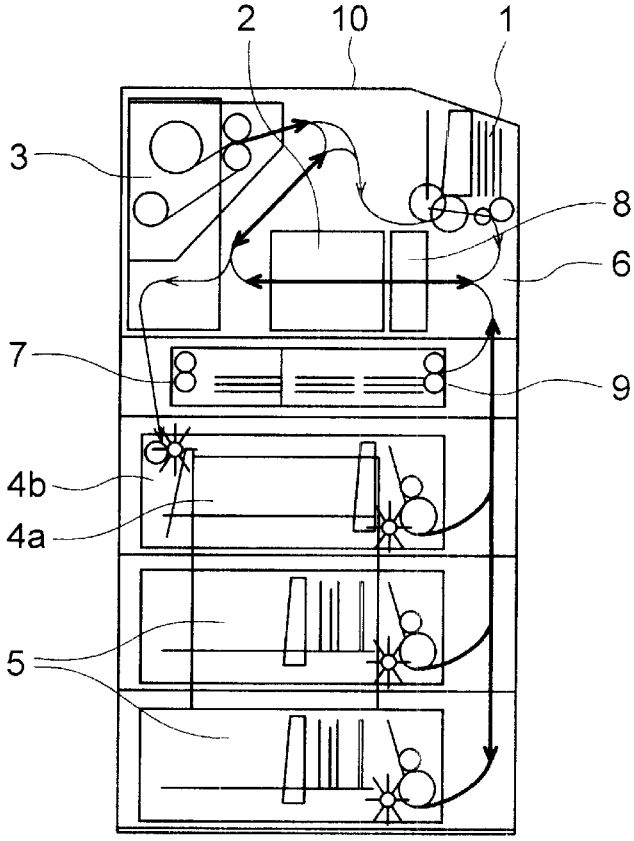
FIG. 1 is a bill handling apparatus according to the present invention.

Referring to FIG. 1, a flow of bills upon money input transaction by customers will be described. When a customer collectively inputs several types of bills of different sizes to an input and output port 1, they are separated from one another at the input and output port 1 and delivered to a conveying path 6. A two-sheet detecting mechanism 8 then determines whether the delivered bills are completely separated from one another or any two bills are overlapping each other. Then, a discriminating device 2 determines whether the bills are authentic, and these different types of bills are temporarily housed in a bill receiving-discharging device 3.

Once the customer ascertains an amount of the money and the money input transaction is completed, the different types of bills in the bill receiving-discharging device 3 are discharged, pass through the conveying path 6, and are then housed in return cassettes 5 or input money cassettes 4 for the corresponding bill types. In this manner, the bill receiving-discharging device 3 of the present invention is used as a temporary stacker for the bill handling apparatus.

If a customer left behind bills, the bills left in the input and output port 1 are separated and conveyed in a left money storage 7. If any bill separated and conveyed from a loading cassette 4*a* or the return cassette 5 is determined to be ineffective by the two-sheet detecting mechanism 8 or the discriminating device 2, that bill is housed in a use reject storage 9. Reference numeral 4*b* denotes a load reject storage for receiving bills which are determined to be inauthentic or to be improperly conveyed when the bills are loaded.

The basic structure of the bill receiving-discharging device 3 will be described with reference to FIGS. 2 to 4.

Figure 2:
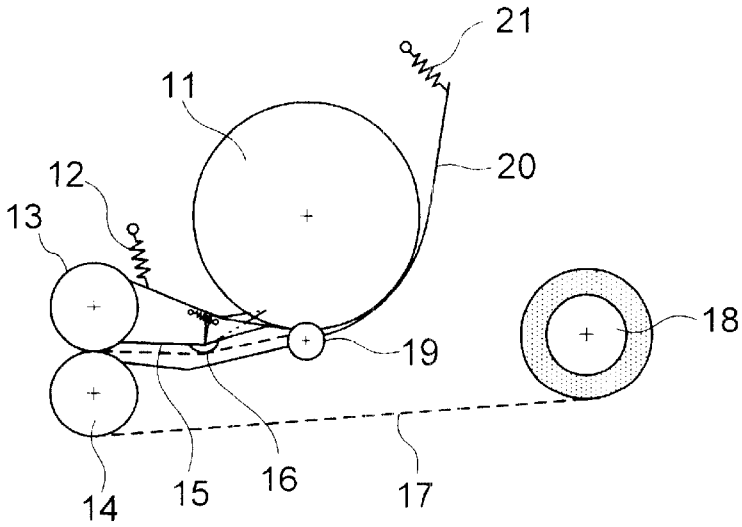
FIG. 2 is a side view of a bill receiving-discharging device according to the present invention (initial state of bill receiving)
Figure 4:
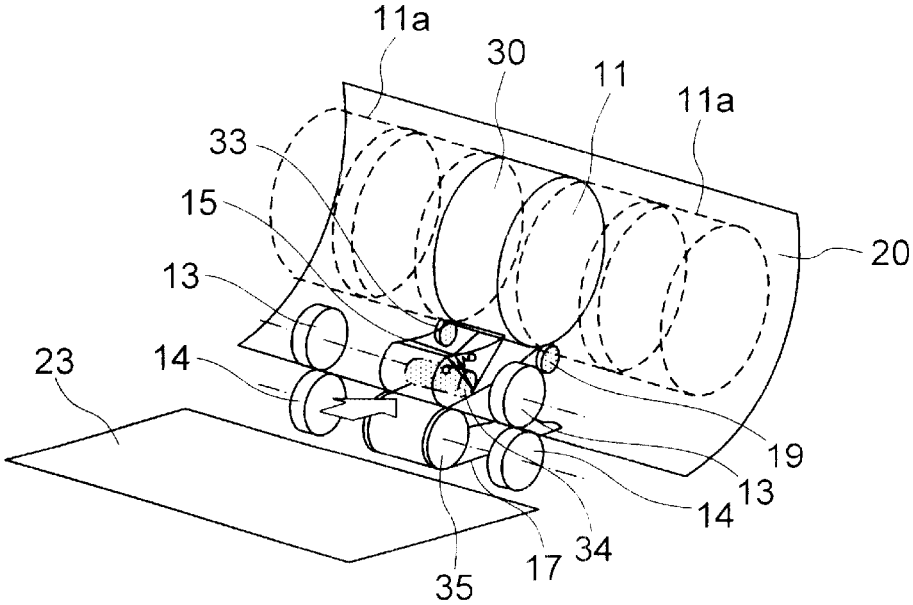
FIG. 4 is a perspective view of the bill receiving-discharging device according to the present invention (initial state of bill receiving)

A tape 17 with one end thereof fixed to and wound around a reel 18 as shown in FIG. 2 has the other end thereof attached to a wheel 11 via an outer peripheral surface of an intermediate roller 35 shown in FIG. 4. The width of the tape is set at a required dimension on the basis of force required to sandwich a bill, force required to restrict extra-face deformation of housed bills, strength of the tape, and the like.

Auxiliary wheels 11*a* (shown by the alternate long and two short dashes line in FIG. 4) running idly and coaxially with the wheel 11 and having substantially the same diameter as the wheel 11 are provided. Conveying rollers 14 are arranged in coaxial with an intermediate roller 35 and are fixed to a shaft. Idle rollers 13 are arranged opposite to the conveying rollers 14 with respect to a bill conveying path and are in pressure contact with the conveying rollers 14. The idle roller 13 and the conveying roller 14 sandwich and convey the bills. A two-staged scraper 15 that pivots around a shaft of the idle rollers 13 is arranged above the intermediate roller 35 as sheet scraping means. The scraper 15 is rotatably journaled so as to rotate around the shaft of the idle rollers 13. A tip of the scraper 15, raised by an elastic member 12 such as a spring (hereinafter referred as a "first elastic member") in a direction in which it is pressed against the wheel 11, is in contact with an outermost periphery 31 (shown in FIG. 3) of the tape 17 wound around the wheel 11.

Further, an auxiliary idle roller 16 is provided on the scraper 15 at its intermediate location so that the auxiliary roller 16 comes into contact with the tape 17 or the bills wound around the wheel 11 together with the tape 17.

Figure 3:
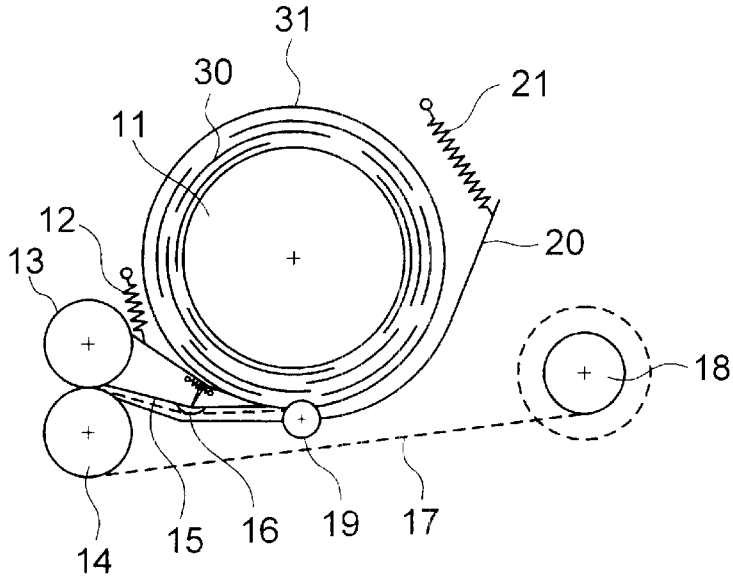
FIG. 3 is a side view of the bill receiving-discharging device according to the present invention (completion state of bill receiving)

Furthermore, a bill guide 20 is pivotably arranged to cause the bills to smoothly follow the wheel 11 upon receiving of the bills, and is partly shaped in, for example, a circular arc larger than the outer peripheral surface 31 of the tape 17 wound around the wheel to house the bills as shown in FIG. 3.

The bill guide 20 comprises a guide rollers 19 that abuts against an outer peripheral surface of a housed bill near a point where the tape 17 is wound around the wheel 11 and near both sides of the wheel 11. The bill guide 20 is raised upward, that is, toward the wheel 11 by a bill guide spring 21, so that the guide rollers 19 is brought into pressure contact with the outer peripheral surface of the housed bills.

The wheel 11 and the reel 18 comprise motors (not shown) and a reel shaft comprises a torque limiter (not shown) so that the wheel 11 and the reel 18 are controllably rotated so that tension applied to the tape becomes substantially constant, thus enabling the tape to be wound around the wheel 11 and to be rewound from the reel 18, respectively.

By setting thickness of the tape 17 as thin as possible and width of the tape narrow and by employing the auxiliary idle wheels, it is possible to reduce the inertial load on a shaft of the wheel 11, thereby increasing speed for processing the bills.

Now, an operation of the two-staged scraper 15 will be described with reference to FIGS. 5 and 6.

When the bill 36 wound around the wheel 11 together with the tape 17 is discharged, the guide rollers 19 applies a wavy deformation to the bill and the bill is scraped from the wheel normally without coming into contact with the tip of the scraper 15 and is then discharged while being sandwiched between the auxiliary roller 16 and the tape 17 if the bill is in a flat form.

If the bill has a significantly low rigidity or has been cut or folded, it may not maintain its wavily deformed state. Additionally, if deformation resistance is larger than deforming force from the guide rollers 19, the bill may not be wavily deformed.

The wavy deformation is applied to allow the bill to be scraped easily from the wheel 11 so as to be discharged to a bill-conveying surface below the scraper. If the deformation cannot be formed or maintained, the bill may travel to and collide against the scraper 15.

As described later, the second scraper 28 constituting the tip of the scraper 15 of this embodiment is rigid and is not rotated more than a predetermined angle. Accordingly, the tip portion is not deformed by collision of the bill 36.

Figure 5:
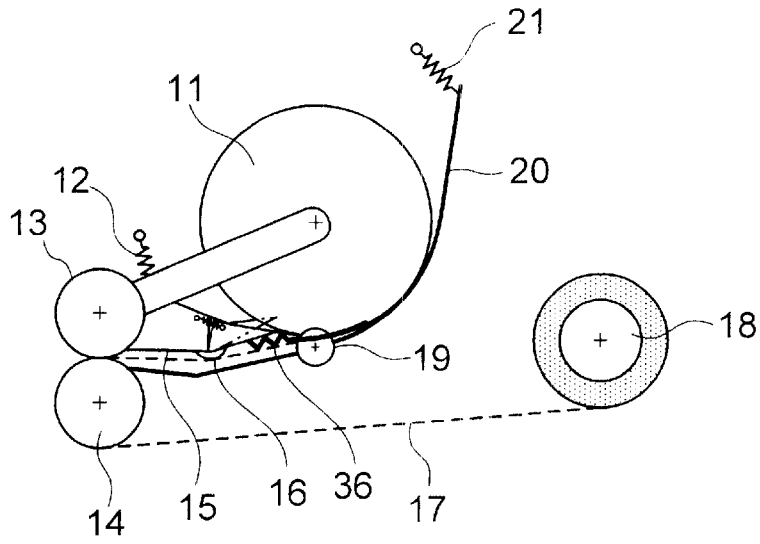
FIG. 5 is an explanatory representation of a method of removing a jammed bill from the bill receiving-discharging device.

Consequently, the bill 36 changes its course after the collision against the scraper 15, is guided by a lower surface of the scraper 15, that is, a surface opposite to the tape 17 and is then discharged while being sandwiched between the auxiliary roller 16 and the tape 17, (FIG. 5).

Figure 6:
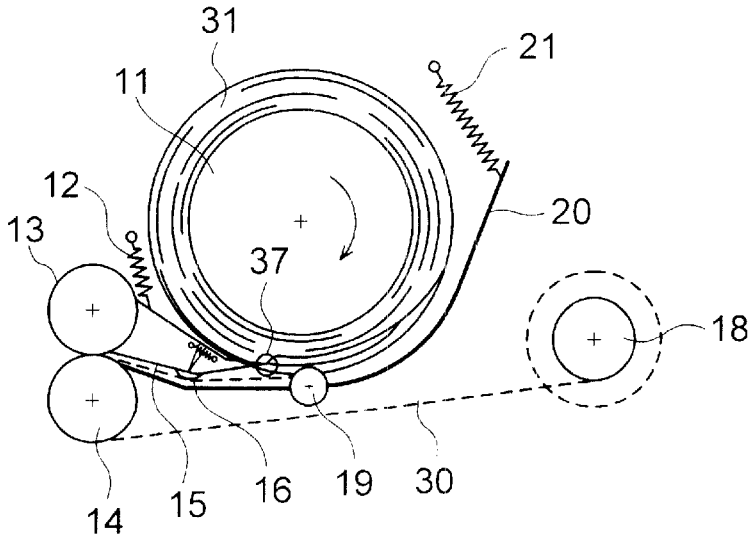
FIG. 6 is an explanatory representation 1 of a behavior of a scraper of the bill receiving-discharging device.

When a large number of bills 30 are wound around the wheel 11 as shown in FIG. 6, the outermost periphery 31 of the tape 17 wound around the wheel is not at least circularly shaped. That is, if any bill has been folded or cut or there is variation in density of the bills in the radial direction, the outermost periphery 31 may be irregular.

Figure 7:
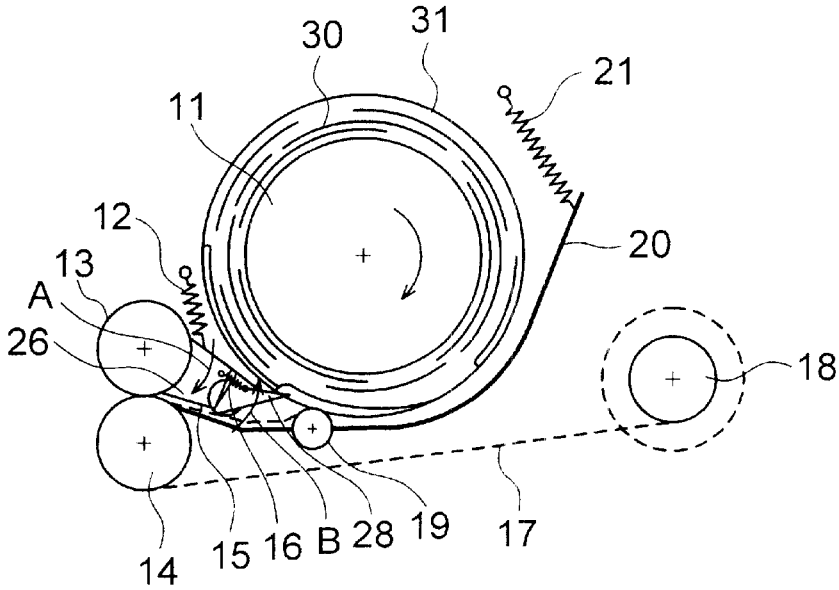
FIG. 7 is an explanatory representation 2 of the behavior of the scraper of the bill receiving-discharging device.

In this case, when the tip of the scraper comes into contact with the irregular shape, the first scraper 26, constituting the scraper 15, is rotated by an impact force upon contact in a direction away from the wheel 11, that is, in a rotational direction A, shown in FIG. 7. At this time, the second scraper 28 is rotated in a rotational direction B, shown in FIG. 7, so as to come into contact with the outermost periphery 31 of the wheel 11. When the second scraper 28 rotates in the rotational direction B so as to maintain contact with the outermost periphery 31 of the wheel 11, the following bills can be discharged (FIG. 7).

If the second scraper 28 is not provided, in other word, if the scraper 15 has an integral structure instead of the two-staged structure, when the tip of the scraper 15 comes into contact with the irregular shape, the scraper is rotated in the rotational direction A due to an impact upon the contact. At this time, a gap may be resulted between the tip of the scraper 15 and the outermost periphery 31, and the bill may slip through this gap.

Further, in a case where the second scraper is an elastic member fixed to the tip of the first scraper 26 as in the prior art, the second scraper is normally initially being deformed. If a tip of said second scraper comes into contact with the above described irregular shape, the first scraper 26 is rotated in the rotational direction A due to an impact upon the contact, while the second scraper returns to the rotational direction B due to reaction force to the initial deformation which recovers the second scraper from its deformed state.

When the bill rushes at the tip of the second scraper in recovering from its deformed state, the second scraper, which is an elastic member, may be bent in the rotational direction B, so that a surface thereof opposite to the surface thereof normally in contact with the outermost periphery 31 may come into contact with the outermost periphery 31. In this state, the second scraper does not provide the function of preventing the bills from slipping through the gap.

When the rigidity of the elastic member of the scraper tip portion is enhanced in order to avoid the above state, the scraper fails to follow the irregularity.

The scraper 15, enabling two or more levels of operations as shown in this embodiment, serves to solve the above problem.

Figure 8:
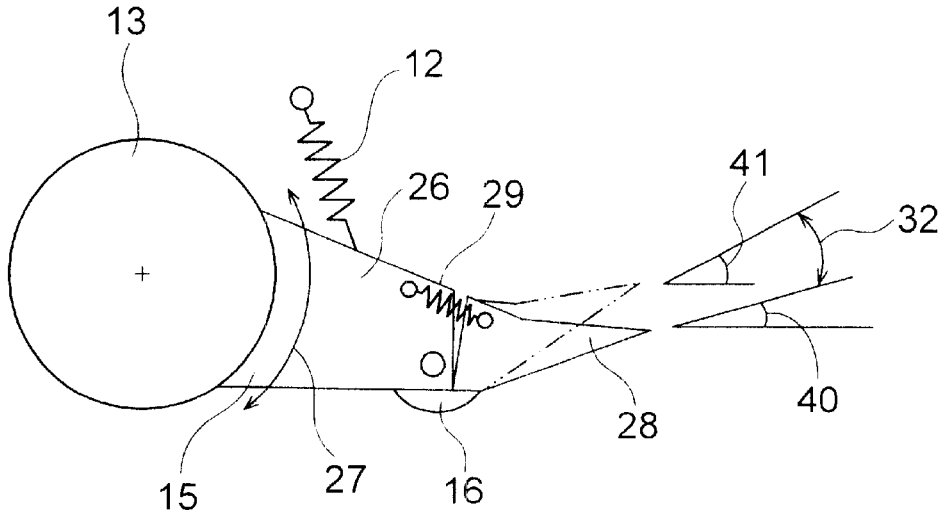
FIG. 8 is a side view showing a structure of the scraper according to the present invention.
Figure 9:
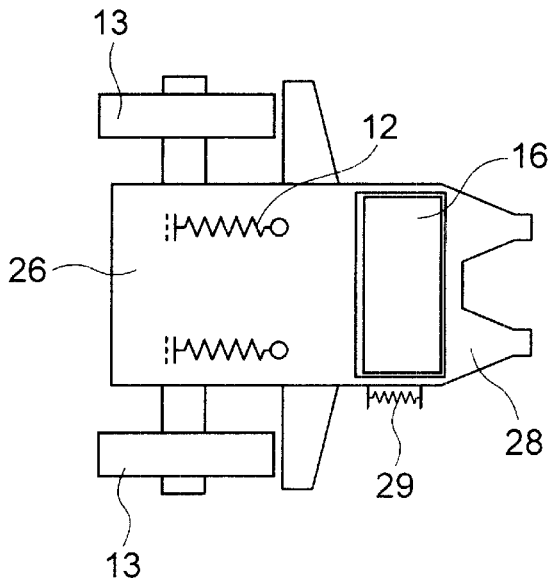
FIG. 9 is a top view showing the structure of the scraper according to the present invention.

FIGS. 8 and 9 show the scraper 15 according to this embodiment.

The first scraper 26 of the scraper 15 is rotatably supported on a shaft of the idle rollers 13 for conveying in a rotational direction 27. The first scraper 26 is elastically supported by the first elastic member 12 such as a spring in an upward direction in the drawing, in other words, in a state to be pressed against the wheel 11.

The second scraper 28 has a rotational center at a tip portion of the first scraper 26, and the first scraper 26 and the second scraper 28 are elastically coupled together by an elastic member 29 such as a spring (hereafter referred to as a "second elastic member") so as to rotate through a predetermined angle. Further, the first scraper 26 has the auxiliary roller 16 for bill conveying.

The first scraper 26 and the second scraper 28 are connected together so as to rotate through a predetermined angle. This predetermined angle is an angle 32 between a first contact angle 40 and a second contact angle 41. That is, the second scraper 28 can be rotated through the predetermined angle 32. Normally, in the state of the angle 40, that is, in the state shown by a solid line in FIG. 8, the second scraper 28 maintains contact with the wheel 11.

The tip portion of the second scraper 28 comprises two projecting portions that are spaced in the width direction of the tape 17 so as to maintain the contact state even if there is an irregularity or an inclination in the width direction of the tape 17.

Next, operation of the scraper 15 will be described in detail. As described above, the tip portion of the scraper 15 of the two-staged structure comes into contact with the outermost periphery of the wheel 11. At this time, the first scraper 26 is urged toward the wheel 11 by the first elastic member 12 such as a spring. On the other hand, the second scraper 28, connected to the tip portion of the first scraper 26 so as to rotate through the predetermined angle, is urged by the second elastic member 29 such as a spring toward the wheel 11, that is, so as to come into contact with the outermost periphery.

The rigidity of the first elastic member 12 is set larger than that of the second elastic member 29. When the tip of the second scraper 28 comes into contact with the outermost periphery of the wheel 11, an angle between the first scraper 26 and the second scraper 28 becomes the angle 40 shown in FIG. 8. That is, the first scraper 26 and the second scraper 28 are applied forces by the elastic members so as to rotate toward the wheel 11.

When the bills are wound around the wheel 11 and the diameter of the wound bills increases, the scraper 15 of the two-staged structure follows the outermost periphery by the first elastic member 12 of the first scraper 26, and the second scraper 28 rotates with the first scraper 26 while maintaining the angle with respect to the first scraper 26.

At this time, the first scraper 26 follows the outer peripheral surface of the wheel 11 due to the expansion and contraction of the first elastic member 12. The second elastic member 29, connecting the first scraper 26 to the second scraper 28, is not expanded or contracted. Accordingly, the second scraper 28 maintains the limit of the range in which it can rotate relative to the first scraper 26, that is, the position shown by the solid line in FIG. 8.

The above configuration of the scraper 15 deals with a case in which an irregular shape is present on the outermost periphery 31 of the tape 17 wound around the wheel 11 as shown in FIGS. 3 and 4.

Figure 10:
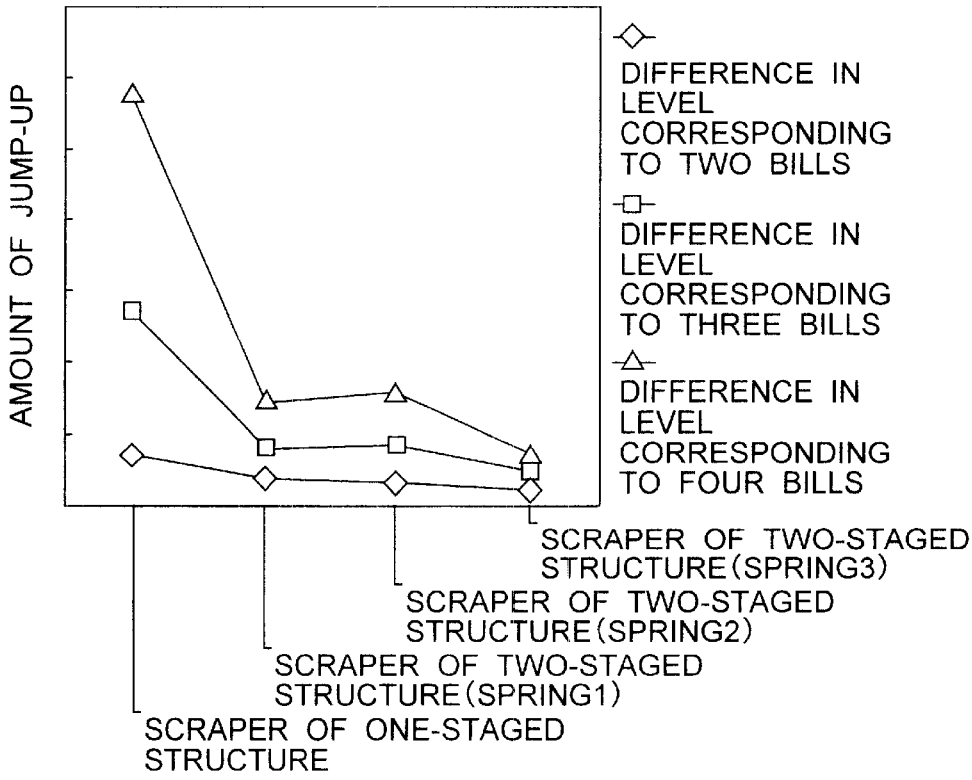
FIG. 10 is a view showing a relationship between a difference in level of an irregular shape and an amount of jump-up.

FIG. 10 is a graph showing the relationship between differences in level for an irregular shape and an amount of jump-up of the tip portion of the scraper 15 from the outermost periphery 31 of the tape 17 wound around the wheel 11. The graph shows a difference in the amount of jump-up between a scraper of a one-staged structure and a scraper of a two-staged structure. As apparent from the graph, as the difference in level increases, it becomes more difficult to maintain the contact between the tip portion of the scraper 15 and the outermost periphery 31 of the tape 17 wound around the wheel 11, leading to problems. The scraper 15 of the two-staged structure, however, has a reduced amount of jump-up and can follow the wheel better.

When an irregular shape is present on the outermost periphery 31 and the tip portion of the scraper 15 comes into contact with this irregular shape, the first scraper 26 is rotated so as to leave the wheel 11, that is, in the rotational direction A shown in FIG. 3, due to an impact upon the contact. This rotation clears the contact between the tip portion of the second scraper 28 and the outermost periphery 31. The second elastic member 29 then acts to rotate the second scraper 28 toward the wheel 11, that is, in the rotational direction B shown in FIG. 4, thus bringing the second elastic member into contact with the outermost periphery 31 again.

Accordingly, even a bill present near the downstream side of the rotational direction of the wheel 11, having an irregular shape, can be scraped from the wheel 11.

That is, the scraper capable of two or more levels of operations can maintain contact with the outer peripheral surface even with an irregular shape and can thus reliably discharge the bills.

Next, how the scraper 15 follows the wheel depending on the type of the elastic member will be described.

If the second elastic member 29, connecting the first scraper 26 and the second scraper 28 together, has excessively high rigidity or spring constant, the scraper 15 cannot maintain the state shown by the solid line in FIG. 8 when the tip portion of the scraper 15 comes into contact with the outermost periphery 31 of the tape 17 wound around the wheel 11.

Thus, the rigidity of the second elastic member 29 must be low enough to allow the tip portion of the second scraper 28 to come into contact with the outermost periphery 31 of the tape 17 wound around the wheel 11, while the second scraper 28 is movable toward the wheel 11 as shown by the solid line in FIG. 8.

On the other hand, the rigidity or spring constant of the second elastic member 29 is preferably increased to increase the speed of a response to the clearance of the contact between the tip portion of the second scraper 28 and the outermost periphery 31 in order to allow the scraper to follow an irregular shape better.

Springs 1, 2, and 3, shown in FIG. 10, are for the second elastic members 29 and have different rigidities or spring constant. The spring 1 is least rigid and the spring 3 is most rigid.

Now, a bill receiving operation according to this embodiment will be described.

When a bill 23 is conveyed through the bill conveying path in the direction shown by an arrow in FIG. 4, the wheel 11 is rotationally driven counterclockwise to wind the tape 17 wound around the reel 18, onto the wheel 11. Further, the intermediate roller 35 is rotationally driven due to the frictional force between itself and the tape 17 wound around its outer peripheral surface, thereby rotationally driving the conveying rollers 14 fixed on the shaft of the intermediate roller 35 and the idle rollers 13.

Accordingly, the bill 23 being conveyed is sandwiched by the conveying rollers 14 and the idle rollers 13, conveyed in the direction shown by the arrow, subsequently sandwiched by the auxiliary roller 16 and the tape 17, and then wound around the outer peripheral surface of the wheel 11 together with the tape 17 for receiving. During the receiving, the bill guide 20 guides the bill so as to allow it to smoothly follow the outer peripheral surface of the wheel 11.

Consequently, when various types of bills 30 conveyed through the bill conveying path are wound around the outer peripheral surface of the wheel together with the tape 17, the bills can be sequentially housed as shown in FIG. 3.

Now, an operation of discharging bills according to this embodiment will be described.

The shaft of the reel 18 shown in FIG. 3 is rotationally driven counterclockwise to rewind the tape 17 wound around the wheel 11 together with the bills 30, onto the reel 18, to discharge the bills 30 wound around the outer peripheral surface of the wheel 11 together with the tape 17. During the discharge, the two guide rollers 19 apply wavy deformation to a tip portion of a bill 36 from which the sandwiching force of the tape has been released, thereby scraping the tip portion of the bill 36 from the outer peripheral surface of the tape 17 wound around the wheel 11.

Bills 36 that cannot be scraped in the above manner are scraped by the tip of the scraper 15 and then guided to a space below the scraper 15, that is, the space between the scraper 15 and the tape 17. The bills 36 pass smoothly through the point sandwiched between the auxiliary roller 16 and the tape 17 and are then discharged to an exterior of the bill receiving-discharging device 3 by the conveying rollers 14 and the idle rollers 13.

As described above, the bill receiving-discharging device 3 according to the present invention can convey various types of bills of different sizes in the direction of their shorter sides, wind them around the wheel 11 at a high speed to house them, and reversely rotate the wheel 11 to discharge the bills.

According to the present invention, it is possible to provide an apparatus for handling paper sheets and the like having a sheets discharging mechanism which can reliably discharge paper sheets and the like.

What is claimed is:

1. An apparatus for handling paper sheets and the like having a mechanism for discharging the paper sheets, said mechanism being provided with means for scraping the paper sheets having wound around a wheel from the wheel, the paper sheets scraping means having a tip portion and an opposite end that is rotatably fixed so that the tip portion can maintain contact with an outer peripheral surface of said wound paper sheets, wherein said paper sheets scraping means performs two pivoting operations and includes first and second sections, wherein said second section is pivotable with respect to said first section so that a tip of said second section is always urged in a direction so as to maintain contact with at least one of the outer peripheral surface of said wound paper sheets and an outer peripheral surface of the wheel.

2. The apparatus according to claim 1, wherein said sheets discharging mechanism comprises a mechanism for receiving the paper sheets by winding the paper sheets around said wheel.

3. An apparatus for handling paper sheets and the like having a mechanism for discharging the paper sheets, said mechanism being provided with a scraper for scraping the paper sheets having wound around a wheel from the wheel, the scraper having a tip end and an opposite end that is rotatably supported in a direction close to or away from the wheel so that the tip end can maintain contact with an outer peripheral surface of said wound paper sheets, wherein said scraper comprises a first scraper section and a second scraper section, said first scraper section is rotatably supported in the direction close to or away from said Wheel, and is urged toward an outer peripheral surface of said wheel, and said second scraper section is rotatably supported on said first scraper section in the direction close to or away from said wheel, and is always urged in a direction in which a tip end of the second scraper section rotates toward at least one of an outer peripheral surface of said wheel and the outer peripheral surface of said wound paper sheets.

4. The apparatus according to claim 3, wherein said sheets discharging mechanism comprises a mechanism for receiving the paper sheets by winding the paper sheets around said wheel.

5. The apparatus according to claim 3, wherein said scraper comprises:

a first elastic member for urging said first scraper section toward said wheel; and a second elastic member for urging said second scraper section toward said wheel, and wherein when said first scraper section rotates in a direction away from said wheel, said second scraper section rotates relative to said first scraper section in a direction in which the second scraper section can maintain contact with said wheel.

6. The apparatus according to claim 5, wherein said sheets discharging mechanism comprises a mechanism for receiving the paper sheets by winding the paper sheets around said wheel.

7. The apparatus according to claim 5, wherein said second scraper section is a rigid body.

8. The apparatus according to claim 7, wherein said sheets discharging mechanism comprises a device for receiving the paper sheets by winding the paper sheets around said wheel.

9. An apparatus for handling paper sheets and the like having a mechanism for discharging the paper sheets, said mechanism being provided with a scraper for scraping the paper sheets having wound around a wheel from the wheel, the scraper having a tip end and an opposite end that is rotatably supported in a direction close to or away from the wheel so that the tip end can maintain contact with an outer peripheral surface of said wound paper sheets, wherein said scraper comprises a first scraper section and a second scraper section, said first scraper section is rotatably supported in the direction close to or away from said wheel, and said second scraper section is rotatably supported on said first scraper section in the direction close to or away from said wheel, and has a tip end urged toward the outer peripheral surface of said wound paper sheets, when the paper sheets are wound around the wheel and a diameter of the wound paper sheets becomes large, said first scraper section rotates so as to follow the diameter of the wound paper sheets and said second scraper section rotates with said first scraper section while maintaining an angle with respect to said first scraper.

10. The apparatus according to claim 9, wherein said scraper comprises:

a first elastic member for urging said first scraper section toward said wheel; and a second elastic member for urging said second scraper section toward said wheel, and wherein when said first scraper section rotates in a direction away from said wheel, said second scraper section rotates relative to said first scraper section in a direction in which the second scraper section can maintain contact with said wheel.

11. The apparatus according to claim 9, wherein said second scraper section is rotatably supported so as to rotate within a predetermined angle range with respect to said first scraper section, and rotates together with said first scraper section while maintaining a limit angle of the predetermined angle range with respect to said first scraper section.

* * * * *